US006805926B2

(12) United States Patent
Cote et al.

(10) Patent No.: US 6,805,926 B2
(45) Date of Patent: Oct. 19, 2004

(54) SECURITY LABEL HAVING SECURITY ELEMENT AND METHOD OF MAKING SAME

(75) Inventors: Paul F. Cote, Hollis, NH (US); Stephen B. Curdo, Hollis, NH (US); Gerald J. Gartner, Hollis, NH (US); Gary R. Wolpert, Mason, NH (US)

(73) Assignee: Technical Graphics Security Products, LLC, Milford, NH (US)

( * ) Notice: Subject to any disclaimer, the term of this patent is extended or adjusted under 35 U.S.C. 154(b) by 109 days.

(21) Appl. No.: 10/081,091

(22) Filed: Feb. 22, 2002

(65) Prior Publication Data

US 2002/0125714 A1 Sep. 12, 2002

Related U.S. Application Data

(60) Provisional application No. 60/270,852, filed on Feb. 23, 2001.

(51) Int. Cl.[7] ..... B44F 1/10

(52) U.S. Cl. ..... 428/29; 428/30; 428/40.1; 428/221; 428/343; 428/354; 428/542.6; 283/71; 283/72; 283/85; 283/91; 283/86; 283/87; 283/88; 283/89; 427/7; 380/572.1

(58) Field of Search ..... 428/29, 30, 211, 428/906.6, 913, 916, 354, 343, 40.1, 542.6; 380/572.1; 283/71, 72, 85–89, 91; 427/7

(56) References Cited

U.S. PATENT DOCUMENTS

| | | | |
|---|---|---|---|
| 4,025,964 | A | 5/1977 | Owens |
| 4,044,231 | A | 8/1977 | Beck et al. |
| 4,112,941 | A | 9/1978 | Larimore |
| 4,183,989 | A | 1/1980 | Tooth |
| 4,274,418 | A | 6/1981 | Vesterager et al. |
| 4,446,204 | A | 5/1984 | Kaule et al. |
| 4,511,616 | A | 4/1985 | Pitts et al. |
| 4,584,529 | A | 4/1986 | Aoyama et al. |
| 4,631,222 | A | 12/1986 | Sander |
| 4,631,223 | A | 12/1986 | Sander |
| 4,652,015 | A | 3/1987 | Crane |
| 4,869,778 | A | 9/1989 | Cote |
| 4,980,569 | A | 12/1990 | Crane et al. |
| 5,016,919 | A | 5/1991 | Rotondo |
| 5,042,842 | A | 8/1991 | Green et al. |
| 5,043,201 | A | 8/1991 | Cote |
| 5,093,184 | A | 3/1992 | Edwards |
| 5,112,672 | A | 5/1992 | Kaule et al. |
| 5,113,062 | A | 5/1992 | Fujita et al. |
| 5,190,318 | A | 3/1993 | Mantegazza |
| 5,265,916 | A | 11/1993 | Coe |
| 5,279,403 | A | 1/1994 | Harbaugh |
| 5,284,363 | A | 2/1994 | Gartner et al. |
| 5,308,992 | A | 5/1994 | Crane et al. |
| 5,354,099 | A | 10/1994 | Kaule et al. |

(List continued on next page.)

FOREIGN PATENT DOCUMENTS

| | | |
|---|---|---|
| DE | 198/24036 A | 6/1999 |
| WO | WO 90/04354 A | 5/1990 |
| WO | WO 98/00193 | 1/1998 |
| WO | WO 98/56293 | 12/1998 |

*Primary Examiner*—Arti R. Singh
(74) *Attorney, Agent, or Firm*—Holland & Bonzagni, P.C.; Mary R. Bonzagni, Esq.

(57) ABSTRACT

A security label having one or more security elements is used on or in association with items, such as consumer products, that have value and are susceptible to counterfeiting. The security label is preferably used as a primary label directly affixed to the item or product. The security element(s) can be affixed to an outer or inner label surface, embedded within the label film or paper layer and/or laminated between two or more layers. One type of security element includes a security thread having indicia formed thereon that are not easily reproduced or duplicated. Another type of security element includes a machine-readable security element that provides encoded machine-readable verification data.

15 Claims, 3 Drawing Sheets

U.S. PATENT DOCUMENTS 5,358,281 A 10/1994 Greig
5,388,862 A 2/1995 Edwards
5,394,969 A 3/1995 Harbaugh
5,417,316 A 5/1995 Harbaugh
5,419,424 A 5/1995 Harbaugh
5,447,335 A * 9/1995 Haslop ..... 283/91
5,457,382 A 10/1995 Stein
5,486,022 A 1/1996 Crane
5,516,153 A 5/1996 Kaule
5,535,871 A 7/1996 Harbaugh
5,543,911 A 8/1996 Jeffers
5,556,372 A 9/1996 Urgovitch et al.
5,583,631 A 12/1996 Lazzerini
5,599,047 A 2/1997 Kaule et al.
5,614,824 A 3/1997 Dames et al.
5,697,649 A 12/1997 Dames et al.
5,770,283 A * 6/1998 Gosselin et al. ..... 428/35.7
5,786,587 A 7/1998 Colgate, Jr.
5,803,503 A 9/1998 Kaule et al.
5,879,373 A 3/1999 Boecker et al.
5,885,211 A 3/1999 Eppstein et al.
6,395,376 B1 * 5/2002 Cooley ..... 428/195.1
6,416,857 B1 * 7/2002 Wright et al. ..... 428/343
2002/0125714 A1 * 9/2002 Cote et al. ..... 283/81
2002/0176975 A1 * 11/2002 Wright et al. ..... 428/213

* cited by examiner

SECURITY LABEL HAVING SECURITY ELEMENT AND METHOD OF MAKING SAME

RELATED APPLICATION

This application claims the benefit of U.S. Provisional Patent Application Ser. No. 60/270,852, filed Feb. 23, 2001, which is fully incorporated herein by reference.

FIELD OF THE INVENTION

The present invention relates to security labels and in particular, to a product label employing a security element, such as a security thread, for verifying the authenticity of an item, such as a consumer product.

BACKGROUND OF THE INVENTION

Counterfeiting of consumer products has become an increasing concern, particularly where the products or goods have a significant value or where the products may cause injury to humans if counterfeited, such as foods and medicines. Counterfeiters often duplicate labels used on food products, such as baby food, and other high priced commodities, such as liquor. The duplicate labels are then applied to tampered or contaminated products, or products of substantially less quality, and are then "passed off" as the higher priced, original product. The counterfeiting of product labels and "passing off" of goods is a common problem with many labeled products including, but not limited to, food and liquor products, beauty products, such as perfume, computer hardware and software products, and replacement parts for machinery and automobiles.

Some security labels have attempted to prevent tampering and/or counterfeiting, such as disclosed in U.S. Pat. Nos. 4,511,616, 5,042,842 and 5,358,261. However, such prior art security labels, which use watermarks and other security indicia, have failed to adequately prevent counterfeiting. Many of these security features used in prior art security labels are easily duplicated by the counterfeiter and reproduced on the label. Some of these prior art security labels also cannot be made without substantial changes to the existing label making process.

Accordingly, a need exists for a security label having a security element, such as a security thread, that authenticates the security label and the product and is not easily duplicated or reproduced by counterfeiters. What is also needed is a method of making such a security label that can easily be incorporated into the existing label-making process.

SUMMARY OF THE INVENTION

The present invention features a security label for use on or in association with an item, to provide verification of the authenticity of the item, and a method of making such a security label. In one embodiment, the security label includes a base layer having opposing outer and inner surfaces, an adhesive layer disposed on at least a portion of the inner surface of the base layer, for adhering the security label to the item, and at least one security element disposed proximate to at least one layer in the security label, for verifying the authenticity of the security label and the item.

Preferably the security element(s) is: laminated to the outer surface of the base layer; at least partially embedded in the base layer; laminated between the base layer and the adhesive layer; and/or affixed to the surface of the adhesive layer used to adhere the security label to the item.

The security element(s) preferably includes a security thread having a substantially narrow construction. One type of security element includes a visually verifiable security element for providing visual authentication. For example, the security element may comprise a substrate having verification indicia formed on at least one surface thereof, so that the verification indicia are visible from at least one side of the security label.

Another type of security element includes a machine-detectable and optionally, machine-readable security element. For example, the machine-detectable security element can include one or more machine-detectable regions (e.g., metal or magnetic regions), while the machine-detectable/machine-readable security element can include encoded (e.g., conductive) regions and non-encoded (e.g., non-conductive) regions, for encoding machine-readable verification data.

The preferred embodiment of the security label further includes at least one release layer, for covering and protecting the adhesive layer prior to adhering the label to the item. The security label is also preferably used as a primary label on items such as consumer products and can also include indicia disposed on an outer surface of the base layer, representing information about the item.

The method of making a security label according to the present invention comprises the acts of: providing a base layer having opposing outer and inner surfaces; providing an adhesive layer on at least a portion of the inner surface of the base layer; and providing at least one security element proximate to at least one layer of the security label. Preferably, the act of providing the security element(s) includes: laminating the security element(s) to the outer surface of the base layer; at least partially embedding the security element(s) in the base layer; laminating the security element(s) between the base layer and the adhesive layer; and/or affixing the security element(s) to the surface of the adhesive layer used to adhere the security label to an item.

The act of providing the security element(s) preferably includes providing one or more security threads having a substantially narrow construction. In one example, the act of providing the security element(s) includes forming verification indicia on at least one surface of the security element. Preferably, the method further includes the act of applying a release layer over the surface of the adhesive layer used to adhere the security label to an item.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1A:
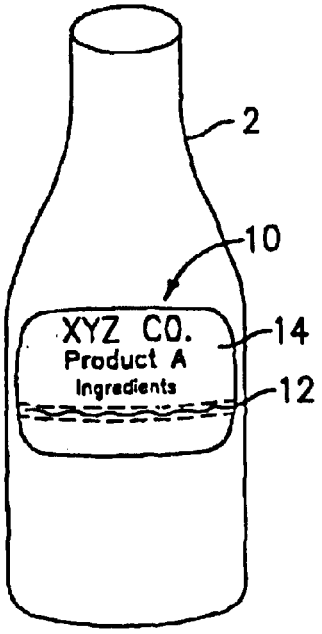
FIG. 1A is a front view of a security label disposed on a product according to the present invention.

A security label 10 (as shown in FIG. 1A), according to a preferred embodiment of the present invention, is used on an item 2, such as a consumer product. The security label 10 includes a security element 12, such as a security thread, that provides a means for verifying the authenticity of the security label 10 and the item or product 2 on which the security label 10 is affixed. The security element 12 includes visible indicia, such as indicia formed on the security element 12, or other visual and/or machine-detectable and optionally, machine-readable verification data, that allows one to verify the authenticity of the security label 10 by visually inspecting the indicia and/or by detecting and optionally, reading the indicia or data with a machine. The security element 12 also has characteristics that are not easily reproduced or duplicated and thereby prevents counterfeiting of the security label 10.

Security label 10 can be used on items or products 2 of value including, but not limited to, food products, such as baby food, alcohol and liquor products, computer products, such as hardware and computer disks, and replacement parts for machines and automobiles. The present invention contemplates using the security label having the security element on any product or commodity in which counterfeiting of labels and pirating or "passing off" of the products is a problem. The preferred use of the security label 10 according to the present invention is as a primary label directly placed on the item or product 2. The present invention, however, also contemplates using the security label 10 as a packaging label. The types of security labels 10 include, but are not limited to, paper labels, film labels, and polypropylene labels.

In one example, the security element 12 is visually detectable upon viewing a front side 14 (as shown in FIG. 1A) of the security label 10, rendering the authenticity of label 10, and the item or product 2 to which it is affixed, readily and immediately verifiable. According to one such embodiment, the security element 12 is either partially embedded in the base layer or laminated to an outer surface thereof. According to another such embodiment, the security label 10 is a clear label through which the security element 12, regardless of its position within label 10, is visually detectable.

Figure 1B:
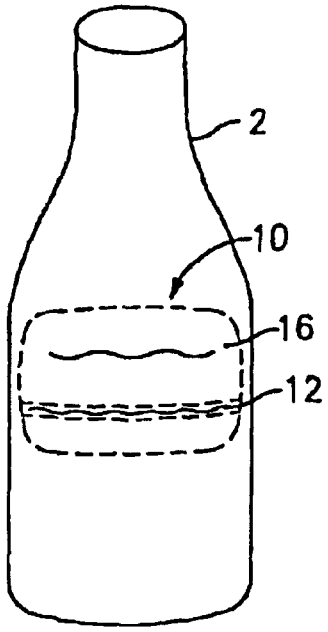
FIG. 1B is a back view of a security label disposed on a product and visible through the product according to one embodiment of the present invention.

According to another embodiment, the security label 10 (as shown in FIG. 1B) includes a security element 12 that is visually detectable through a rear side 16 of the security element 10. According to this embodiment, the security label 10 is preferably used on an item or product 2 through which the security element 12 is visually detectable, such as a clear container. According to a further embodiment (not shown), the security element 12 is hidden between a dark label and the item or product 2 and is visually detectable only when the security label 10 is pulled up or removed from the item or product 2.

Figure 2:
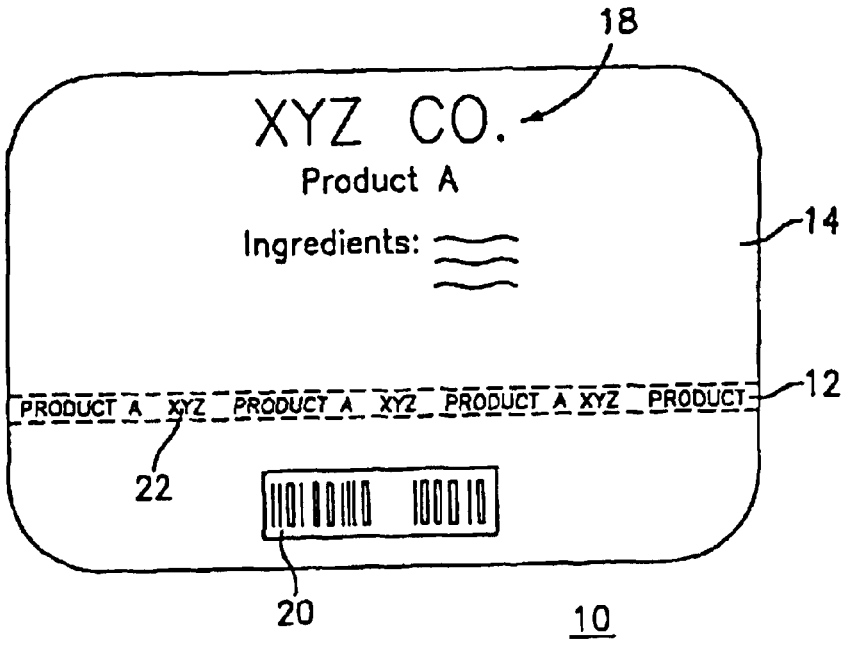
FIG. 2 is a front view of a security label having a security element according to the present invention.

The security label 10 (as shown in FIG. 2) preferably has indicia 18 formed (e.g., printed) on one or more sides of the security label 10 including, but not limited to, the company name, company logo, the product name, brand name, the ingredients, and any other information pertaining to the item or product. The security label 10 can also include a bar code 20 or other encoded symbol providing machine-readable encoded data pertaining to the product.

According to a preferred embodiment, the security element 12 is a security thread having a substantially narrow construction, such as that disclosed in U.S. Pat. Nos. 4,869,778 or 5,043,201, which are incorporated herein by reference. In a more preferred embodiment, the security element 12 comprises a metal, magnetic, metal/magnetic, or luminescent thread. In yet a more preferred embodiment, the security element 12 comprises a thread having indicia 22 formed on at least one surface thereof. For example, the security element 12 can include a metal or metallic thread having non-metallic indicia printed thereon. Alternatively, the security element 12 can include a non-metallic thread having metal or metal-formed indicia contained thereon. The security thread and indicia 22 are preferably of types that are not easily reproduced by counterfeiters.

According to another example, the security element 12 is a machine-detectable security thread. According to this example, one or more of the materials used to prepare the thread and/or indicia 22 are machine detectable.

According to yet another example, the security element 12 is a machine-readable security element. According to this example, the security element 12 comprises a thread having encoded regions (e.g., conductive regions), and non-encoded regions (e.g., non-conductive regions) disposed between each of the encoded regions. The encoded or conductive regions may have varying lengths that are arranged in a predetermined pattern corresponding to encoded verification data.

For example, long and short encoded or conductive regions can be used to provide a binary representation of encoded verification data, for example, long encoded or conductive regions corresponding to a "1" or "on" bit and short encoded or conductive regions corresponding to a "0" or "off" bit. The varying lengths of the encoded or conductive regions are detectable by a verification device, such as an electromagnetic verification device using capacitance verification, to determine the predetermined pattern of the varying lengths of the encoded or conductive regions and the binary representation encoded therein. The present invention also contemplates other types of machine-readable encoded security elements.

The security label 10 (as shown in FIGS. 3 to 7) generally includes a base layer 24 and an adhesive layer 26 applied to the base layer 24. One example of the base layer 24 includes a layer of paper stock or other similar material used with paper labels, film labels, polypropylene labels or the like. One example of the adhesive 26 includes a pressure sensitive adhesive. A release layer 28 preferably covers the adhesive layer 26 prior to applying the security label 10. One example of the release layer 28 includes backing paper having a release coating 30, such as a silicone coating. The present invention contemplates security labels having one or more base layers, adhesive layers and release layers of various materials and constructions as well as additional layers or constructions that are known to those skilled in the art.

Figure 3:
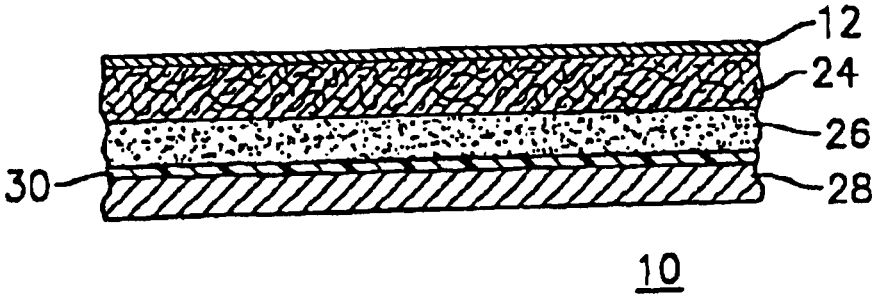
FIG. 3 is a side, cross-sectional view of a security label having a security element laminated to an outer surface of a base layer thereof according to one embodiment of the present invention.
Figure 4:
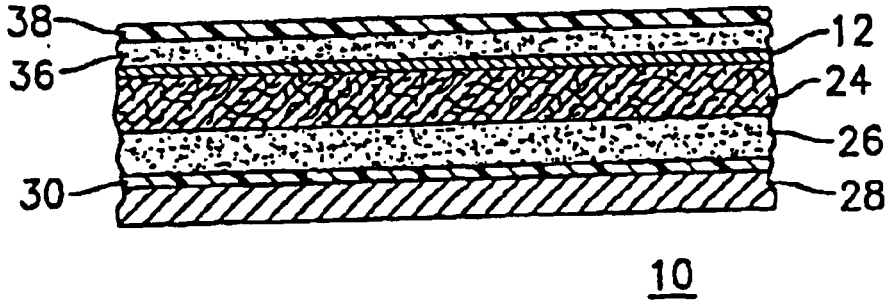
FIG. 4 is a side, cross-sectional view of a security label having a security element laminated between clear laminating and adhesive layers and a base layer thereof according to another embodiment of the present invention.

According to one embodiment (as shown in FIG. 3), one or more security elements 12 is/are laminated to an outer surface of base layer 24. In a preferred embodiment (as shown in FIG. 4) security element(s) 12 is disposed under a laminating adhesive layer 36 and a clear laminating layer 38. A method of making a security label 10 according to these embodiments includes the acts of laminating one or more security elements 12 to an outer surface of base layer 24, applying adhesive to at least a portion of an inner surface of base layer 24, applying a release layer 28 (containing release coating 30) over the adhesive layer 26 and optionally, applying a laminating adhesive layer 36 to the outer surface of base layer 24 containing security element(s) 12, and then applying a clear laminating layer 38 to adhesive layer 36.

Figure 5:
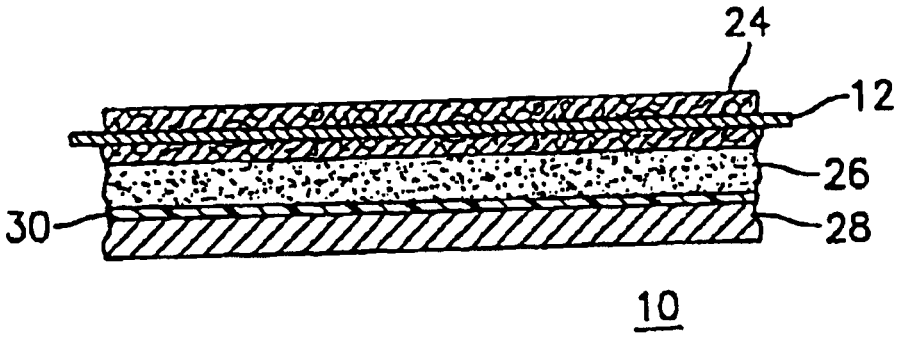
FIG. 5 is a side, cross-sectional view of a security label having a security element embedded within a base layer thereof according to yet another embodiment of the present invention.

According to another embodiment (as shown in FIG. 5), the security element 12 is totally embedded within the base layer 24. A method of making a security label 10 according to this embodiment includes embedding one or more security elements 12 in the base layer 24, such as paper stock, applying the adhesive layer 26 to at least one side of the base layer 24 having the security element 12 embedded therein, and applying the release layer 28 (containing release coating 30) over the adhesive layer 26. The release layer 28 (containing release coating 30) is then removed prior to adhering the security label 10 to an item or product (not shown).

Figure 6:
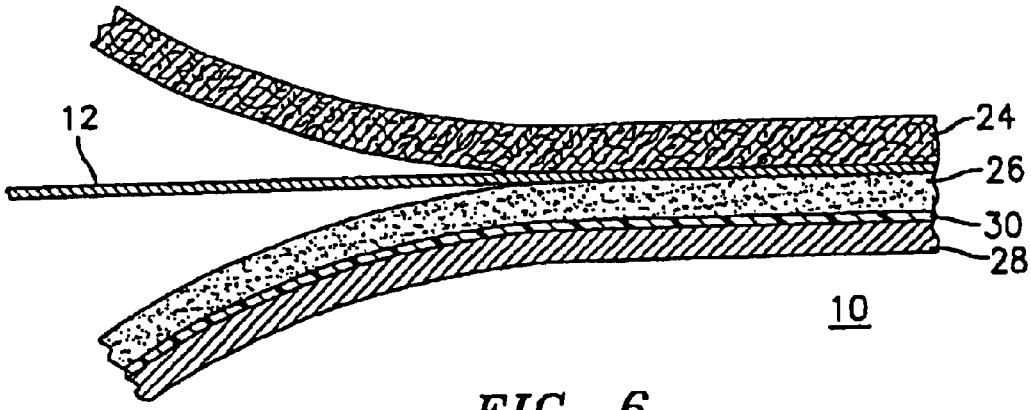
FIG. 6 is a side, cross-sectional view of a security label having a security element laminated between a base layer and an adhesive layer thereof according to a further embodiment of the present invention.

According to yet another embodiment (as shown in FIG. 6), the security label 10 includes one or more security elements 12 laminated between the base layer 24 and the adhesive layer 26. The method of making a security label 10 according to this embodiment includes the acts of providing the base layer 24, such as paper stock, and laminating the security element 12 between the base layer 24 and the adhesive layer 26 disposed on release coating 30 and release layer 28. For example, the method of making the security label 10 can include an existing label making process with the additional novel act of laminating one or more security elements 12 between the base layer 24 and the adhesive layer 26 during the label making process.

Figure 7:
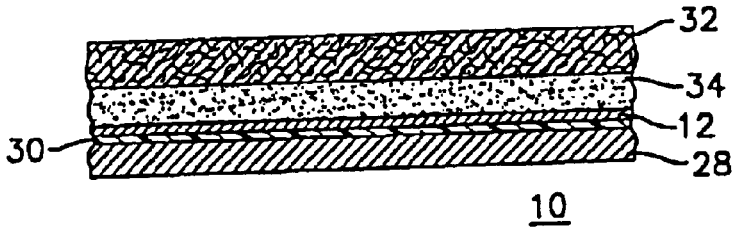
FIG. 7 is a side, cross-sectional view of a security label having a security element laminated to a clear adhesive layer thereof according to yet a further embodiment of the present invention.
Figure 8:
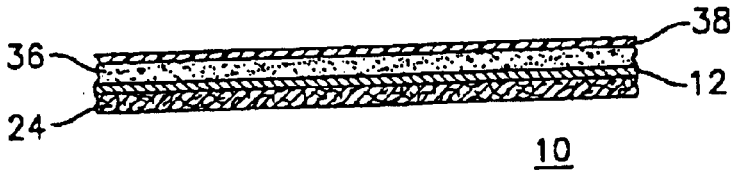
FIG. 8 is a side, cross-sectional view of a non-adhesive security label having a security element laminated between clear laminating and adhesive layers and a base layer thereof according to yet a further embodiment of the present invention.

In yet another embodiment (as shown in FIG. 7), the security thread 12 may be laminated under a clear base layer 32 and a clear adhesive layer 34. In a further embodiment (as shown in FIG. 8), the security thread may be utilized in a non-adhesive paper or plastic label, wherein security element 12 is laminated to an outer surface of base layer 24, which is a paper or plastic printed film layer, and is disposed under a laminating adhesive 36 and a clear laminating layer 38.

Accordingly, the present invention provides a security label having a security element that is not easily reproduced or duplicated and thereby provides a security label that cannot easily be counterfeited. The method of making the security label is a relatively simple process that can easily be incorporated into an existing label-making process for both adhesive and non-adhesive labels.

Modifications and substitutions by one of ordinary skill in the art are considered to be within the scope of the present invention, which is not to be limited except by the claims that follow.

What is claimed is:

1. A security label for use on an item to verify the authenticity of said item, wherein said security label comprises:

(a) at least one base layer; and (b) at least one security element disposed proximate to at least one layer of said security label, wherein said at least one security element comprises a substrate having verification indicia formed on at least one surface thereof for verifying the authenticity of said item, wherein said verification indicia are selected from the group of visually detectable verification indicia, machine-detectable verification indicia, machine-readable verification indicia, machine-detectable and machine-readable verification indicia, and combinations thereof, and wherein said visually detectable verification indicia are visible from at least one side of said security label.

2. A security label for use on an item to verify the authenticity of said item, wherein said security label comprises:

(a) at least one base layer;

(b) at least one adhesive layer disposed on at least a portion of at least one said base layer, for adhering said base layer and said security label to said item; and (C) at least one security element disposed proximate to at least one layer of said security label, wherein said at least one security element comprises a substrate having verification indicia formed on at least one surface thereof for verifying the authenticity of said item, wherein said verification indicia are selected from the group of visually detectable verification indicia, machine-detectable verification indicia, machine-readable verification indicia, machine-detectable and machine-readable verification indicia, and combinations thereof, and wherein said visually detectable verification indicia are visible from at least one side of said security label.

3. The security label of claims 1 or 2, wherein one said base layer is an outermost layer of said security label, and wherein at least one said security element is laminated to an outer surface of said outermost base layer.

4. The security label of claims 1 or 2, wherein at least one said security element is at least partially embedded in at least one said base layer.

5. The security label of claim 2, wherein at least one security element is laminated between one said base layer and one said adhesive layer.

6. The security label of claim 2, wherein one said adhesive layer is an innermost layer of said security label, and wherein at least one said security element is laminated to an outer surface of said innermost adhesive layer.

7. The security label of claim 2, wherein at least one said adhesive layer includes a pressure sensitive adhesive.

8. The security label of claim 2, wherein one said adhesive layer is an innermost layer of said security label, wherein said security label further comprises a release layer covering and protecting said innermost adhesive layer, and wherein said release layer is removed prior to adhering said security label to said item.

9. The security label of claims 1 or 2, wherein at least one said security element is a visually detectable security element.

10. The security label of claims 1 or 2, wherein said security element is a machine-detectable security element.

11. The security label of claims 1 or 2, wherein said security element is a machine-detectable and machine-readable security element.

12. The security label of claim 11, wherein said security element is an encoded security element comprising a substrate having verification indicia comprising encoded and non-encoded regions contained thereon.

13. The security label of claims 1 or 2, wherein said security label is a primary label, and wherein said item is a consumer product.

14. The security label of claims 1 or 2, wherein one said base layer is an outermost layer of said security label, and wherein an outer surface of said outermost base layer contains indicia representing information about said item.

15. A verifiable consumer product comprising a security label affixed to a surface thereof, wherein said security label comprises:

(a) at least one base layer;

(b) at least one adhesive layer disposed on at least a portion of at least one base layer, wherein an innermost adhesive layer affixes said security label to a surface of said consumer product; and (C) at least one security element disposed proximate to at least one layer of said security label, wherein said at least one security element comprises a substrate having verification indicia formed on at least one surface thereof for verifying the authenticity of said item, wherein said verification indicia are selected from the group of visually detectable verification indicia, machine-detectable verification indicia, machine-readable verification indicia, machine-detectable and machine-readable verification indicia, and combinations thereof, and wherein said visually detectable verification indicia are visible from at least one side of said security label.

* * * * *